US010562690B2

(12) United States Patent
Plazarte

(10) Patent No.: US 10,562,690 B2
(45) Date of Patent: Feb. 18, 2020

(54) VALVE ASSEMBLY FOR A FOOD STORAGE CONTAINER

(71) Applicant: Sunbeam Products, Inc., Boca Raton, FL (US)

(72) Inventor: Enrique Plazarte, Fort Lauderdale, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 69 days.

(21) Appl. No.: 15/888,347

(22) Filed: Feb. 5, 2018

(65) Prior Publication Data

US 2018/0222659 A1 Aug. 9, 2018

Related U.S. Application Data

(60) Provisional application No. 62/456,032, filed on Feb. 7, 2017.

(51) Int. Cl.
*B65D 81/20* (2006.01)
*B65D 51/16* (2006.01)
*B65D 43/02* (2006.01)

(52) U.S. Cl.
CPC ..... *B65D 81/2038* (2013.01); *B65D 43/0202* (2013.01); *B65D 51/1683* (2013.01); *B65D 2543/00203* (2013.01)

(58) Field of Classification Search
CPC ..... B65F 1/00–1/068; B65B 67/00–67/1222; B65D 63/00–63/18; B65D 5/6647; B65D 5/6673; B65D 45/16; B65D 90/205; B65D 2571/00944
See application file for complete search history.

(56) References Cited

U.S. PATENT DOCUMENTS 4,051,971 A * 10/1977 Saleri ..... B65D 51/1683 215/228
5,195,427 A * 3/1993 Germano ..... B65B 31/047 141/65
6,557,462 B1 * 5/2003 Wang ..... A47J 47/10 219/732
7,096,893 B2 * 8/2006 Vilalta ..... B65B 31/047 141/65
9,546,032 B2 * 1/2017 Reilly ..... B65D 81/2038
2002/0144740 A1 * 10/2002 Skeens ..... B65D 47/247 137/845

(Continued)

*Primary Examiner* — Kareen K Thomas
(74) *Attorney, Agent, or Firm* — Husch Blackwell LLP

(57) ABSTRACT

A valve assembly for use on a food storage container including an opening formed in the lid member, at least one air hole formed adjacent thereto, a valve member extending through the lid opening having a portion thereof extending over the at least one air hole when the valve member is in its closed position, the valve member being movable to an open position wherein the portion of the valve member extending over the at least one air hole is at least partially uncovered from the at least one air hole when a vacuum is generated within the storage container, and a vacuum release button engageable with the valve member and movable from a first position wherein the valve member remains in its closed position to a second position wherein the valve member is moved to its open position for releasing the vacuum generated within the storage container.

20 Claims, 4 Drawing Sheets

(56) References Cited

U.S. PATENT DOCUMENTS

| | | | | |
|---|---|---|---|---|
| 2003/0197011 | A1* | 10/2003 | Nieh | B65D 81/2015 220/231 |
| 2004/0040618 | A1* | 3/2004 | Vilalta | B65B 31/047 141/65 |
| 2005/0061812 | A1* | 3/2005 | Vilalta | B65D 51/1683 220/212 |
| 2005/0061813 | A1* | 3/2005 | Vilalta | B65B 31/047 220/212 |
| 2006/0118565 | A1* | 6/2006 | Higer | B65D 79/005 220/580 |
| 2008/0073366 | A1* | 3/2008 | Backaert | B65D 79/005 220/785 |
| 2010/0102058 | A1* | 4/2010 | Turvey | B65D 81/2038 220/203.29 |
| 2010/0200588 | A1* | 8/2010 | Bergman | B65D 81/2038 220/203.01 |
| 2010/0237070 | A1* | 9/2010 | Coonce | B65D 45/20 220/203.29 |
| 2010/0263328 | A1* | 10/2010 | Dorsey | B65D 43/0218 53/432 |
| 2012/0199582 | A1* | 8/2012 | Cai | B65D 21/0209 220/203.04 |
| 2012/0267369 | A1* | 10/2012 | Duvigneau | B29C 45/0081 220/203.01 |
| 2015/0307254 | A1* | 10/2015 | Reilly | B65D 81/2038 220/367.1 |

* cited by examiner

VALVE ASSEMBLY FOR A FOOD STORAGE CONTAINER

CROSS REFERENCE TO RELATED APPLICATIONS

This application is claiming priority to U.S. Provisional Application Ser. No. 62/456,032 filed Feb. 7, 2017, the entire disclosure of which is incorporated herein by reference.

BACKGROUND OF THE INVENTION

The present invention relates generally to food storage containers and, more particularly, to a valve assembly associated with the lid member of a food storage container that is configured to allow a vacuum system to be attached thereto so that food products stored within the container can be stored in a refrigerator, pantry or other food storage area under vacuum for everyday use. The present valve assembly also includes a vacuum indicator for notifying the user that an airtight vacuum seal has been achieved.

Storing food, vegetables, herbs, preparation ingredients and leftovers is common practice. Typically these products are stored in ordinary food containers which can be placed in refrigerators, pantries and other storage locations. Ordinary food storage containers are stored at ambient pressure, and over short periods of time, the food stored in these containers will spoil, waste or become unusable and will have to be thrown away. Vacuum sealing food products have been known to extend the freshness and useful life of food products stored within vacuum sealed containers thereby reducing food waste and spoilage.

It is therefore desirable to provide a valve assembly for use with food storage containers so that food products stored therewithin can be vacuum sealed to extend their useful life and freshness, and which containers can be easily stored in refrigerators, pantries and other food storage locations for everyday use.

Accordingly, the present invention is directed to a valve assembly specifically configured for use on a food storage container for allowing the container to be vacuum sealed to protect food products stored therewithin under vacuum from spoilage and waste, and to extend the freshness and useful life of the food products as compared to other ordinary non-vacuum storage containers.

SUMMARY OF THE INVENTION

The present invention is directed to a valve assembly for use on a wide variety of food storage containers for allowing a vacuum system to be mated with the container for drawing a vacuum therewithin to preserve and protect the food product stored therein. The present food storage containers incorporating the present valve assembly are specifically designed for use in refrigerators, pantries and on the go use and allow the food products stored therein to retain their freshness and extend their normal useful life over food products stored in ordinary non-vacuum food storage containers. The present containers incorporating the present valve assembly represent a new line of food storage containers that work with all FoodSaver® vacuum seal products and handheld vacuum sealers to remove air from within the container and create a unique airtight seal. The present containers come in a wide variety of different sizes for different applications and for storing many different types of food items including meats, poultry, fish, fruits, vegetables, herbs, preparation ingredients, pantry items, meals, snacks on the go and much more. The present vacuum sealed food storage containers reduce food waste so that you can enjoy what you would ordinarily lose to spoilage. These containers are made for everyday refrigerator, pantry and on the go storage.

The present valve assembly is typically incorporated into the lid member of a food storage container. The lid member will include a central opening for receiving the valve member and will likewise include at least one air hole positioned adjacent to the central opening for allowing air into and out of the container. The valve member includes an annular flange or flap portion which extends over and covers the at least one air hole providing access to the interior of the container. Typically a plurality of air holes are positioned and arranged around the central opening and the valve member is typically annular in shape so that it completely seals the interior portion of the central opening from the inside of the lid member and its annular flange or flap portion completely seals any plurality of air holes positioned adjacent thereto from the exterior side of the lid member when the valve member is positioned within the central opening. The valve member also includes a central cavity for receiving a stem portion associated with a vacuum release button. The stem portion of the vacuum release button likewise extends into the central opening formed in the lid member and mates with and extends into the cavity associated with the valve member. The vacuum release button is movable from a first position wherein the release button allows the annular flap portion of the valve member to remain in its closed position extending over and covering the adjacent air holes and it is slidably movable downwardly in a vertical direction to a second position so as to move and flex the angular flap portion of the valve member to at least partially uncover the air holes so as to allow air to enter the food container and evacuate any vacuum previously generated within the container.

The lid member is also configured to receive and mate with a vacuum adapter associated with a vacuum seal appliance over the valve assembly contained in the lid member. In one embodiment, the lid member includes an annular flange or lip portion surrounding the vacuum release button for engaging the vacuum adapter associated with a typical vacuum seal appliance such as the FoodSaver® vacuum seal appliance, a handheld sealer, or any other vacuum adapter configured to engage the lid member. A dust/particle cover is also engageable with the inner portion of the lid member so as to cover the valve member and to protect the valve member from dust and other particles which may cause vacuum leaks or clog the air holes for both pulling a vacuum on the container as well as releasing the vacuum from the container when desired.

Operation of the present valve assembly is as follows. When the present food storage container is at ambient pressure in its non-vacuum configuration, the vacuum release button is in its first position and the valve member is in its closed position and extends over and completely covers both the central opening in the lid member and any plurality of air holes associated with the lid member. When a vacuum is desired, a vacuum adapter is attached to the lid member over the present valve assembly, the vacuum adapter being connected to a vacuum seal appliance through the use of a hose which connects the vacuum adapter to the vacuum pump associated with the vacuum seal appliance. In one embodiment, the vacuum adapter engages an annular lip or flange surrounding the vacuum release button thereby forming an airtight seal with the annular flange of the lid member for pulling a vacuum. When the vacuum pump within the vacuum seal appliance is activated, the annular flange or flap associated with the valve member is pulled or flexed upward away from the plurality of air holes associated with the lid member thereby allowing air from within the food storage container to be evacuated through the air holes and out through the top of the lid member. The vacuum release button remains in its first position during the vacuum process. Once the vacuum pump associated with the vacuum seal appliance is deactivated, the loss of vacuum pressure closes the valve member and the annular flap portion of the valve member is again allowed to extend over and cover any plurality of air holes associated with the lid member. This seals and contains the vacuum formed within the food storage container. This also seals the lid member to the storage container in an airtight vacuum seal configuration.

When it is time to remove the food product stored within the food storage container, a user will depress the vacuum release button and move the release button downwardly to its second position wherein it engages the valve member and allows the annular flap portion of the valve member to again flex so that the plurality of air holes are at least partially uncovered to allow the vacuum contained within the container to escape through the air holes and allow ambient air to again enter the container so as to equalize the pressure therewithin. This now allows a user to remove the lid member from the food storage container so as to have access to the products stored therewithin. When the vacuum release button is released, the release button moves back to its first position and the valve member returns to its closed position wherein the annular flap portion again extends over and covers any plurality of air holes associated with the lid member.

The lid member may also include a vacuum indicator to notify a user when a predetermined vacuum has been generated within the food storage container. The vacuum indicator may include a dimple silicone member which depresses from a convex position to a concave position when a predetermined airtight vacuum seal has been generated between the lid member and the food storage container.

In one embodiment, the present valve member can be made of a silicone material which allows flexibility for the annular flap portion to flex between its open and closed positions covering and uncovering the plurality of air holes associated with the lid member. The lid member itself can be made from any plastic or other suitable material including a clear BPA free, Tritan® material for superior performance. In addition, the central opening through the lid member for receiving the valve member can take on a wide variety of different shapes including circular, oval, square, rectangular or any other annular or polygonal shape. Importantly, this shape needs to be compatible with the shape of the vacuum adapter which will be engaged with the lid member over the top of the present valve assembly. This central opening can also be located anywhere on the lid member.

These and other aspects and advantages of the present valve assembly and associated food storage containers will become apparent to those skilled in the art after considering the following detailed description in connection with the accompanying drawings.

BRIEF DESCRIPTION OF THE DRAWINGS

For a better understanding of the present invention, reference may be made to the following accompanying drawings.

DETAILED DESCRIPTION OF THE INVENTION

Figure 1:
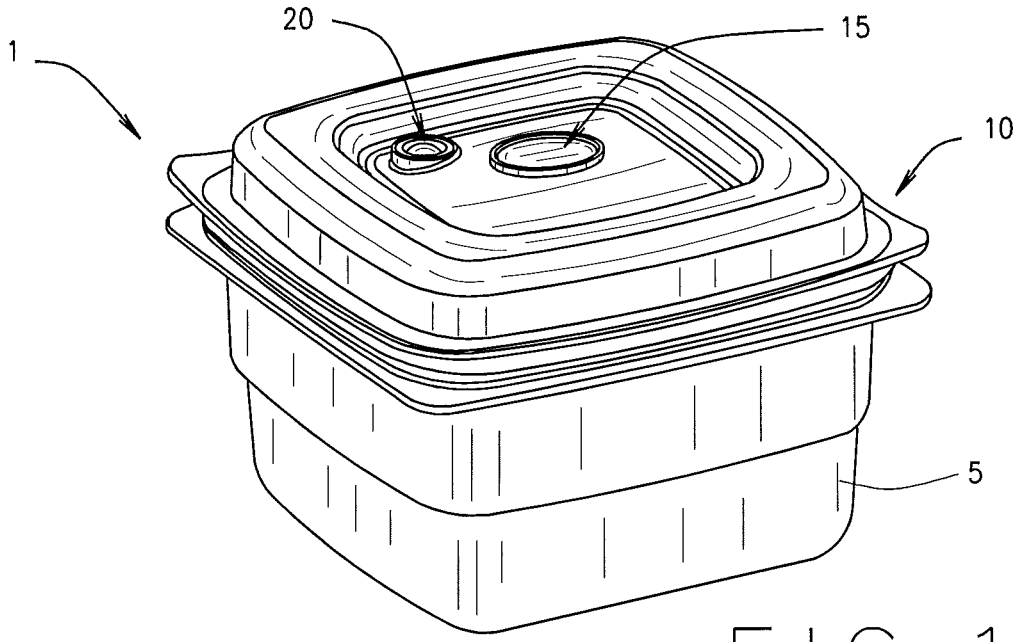
FIG. 1 is a perspective view of one embodiment of a food storage container system incorporating the present valve assembly and vacuum indicator constructed according to the teachings of the present invention.

Turning first to FIG. 1, a food storage container system 1 is provided. Like many food storage systems known and understood in the art, the food storage system 1 preferably includes each of a food storage container 5 and a lid member 10. The food storage container 5, like many of those that are used in the food storage industry, includes at least one storage cavity or compartment in which perishable and/or nonperishable foods, herbs, or spices may be stored when not in use. The container 5 and lid member 10 may be made of a variety of rigid or semi-rigid materials, but in the preferred embodiment, both are made of a BPA-free dishwasher safe material. The food storage system 1 may be stored, for example, in a pantry, in a refrigerator, or it can be used on the go.

The lid member 10 shown in FIG. 1 is shaped and recessed to be nestable within, or even releasably engageable with, bottom portions of food storage containers 5 of other food storage systems. However, in alternative embodiments, the lid member 10 may be substantially flat, as may be the bottoms of other food storage containers. The lid member 10 is preferably releasably engageable with the food storage container 5. The manner in which the lid member 10 may be releasably engaged with the food storage container 5 may take on many forms, but in one embodiment, the lid member 10 is releasably engaged with the food storage container 5 by a friction fit. Moreover, the seal formed between the lid member 10 and the food storage container 5 is preferably airtight. The airtightness of the seal may be improved by known techniques, for example, by use of O-rings, gaskets, and the like. In the embodiment illustrated in FIG. 1, the food storage container 5 and the lid member 10 are each substantially rectangular in shape and more particularly, square in shape. In alternative embodiments, the food storage container 5 and the lid member 10 may be shaped as elongated rectangles, circles, ovals, or other foreseeable shapes.

The food storage system 1 of the present invention includes a valve assembly 15 that can be used with a vacuum adapter and/or vacuum seal appliance such as the FoodSaver® vacuum seal appliance, handheld vacuum sealers, or the like to create a vacuum within the food storage container 5 to increase the shelf life of the contents within the food storage container 5. Moreover, the valve assembly 15 may also be used in a manner described hereinbelow to release vacuum pressure from within the food storage container 5 and allow air to enter the food storage container 5 and evacuate the vacuum pressure therein when a user wishes to access contents within the food storage container 5. The valve assembly 15, as will be described in much greater detail below, is preferably located on the lid member 10.

In addition to the valve assembly 15, a vacuum indicator 20 may also be located on the lid member 10. The vacuum indicator 20 signals to a user whether predetermined vacuum has been created within the food storage container 5, and thus whether its contents are currently being preserved by an airtight vacuum seal between the lid member 10 and the food storage container 5. Alternatively, the vacuum indicator 20 may signal to a user whether contents within the food storage container 5, if any, are in a vacuum environment.

Figure 2:
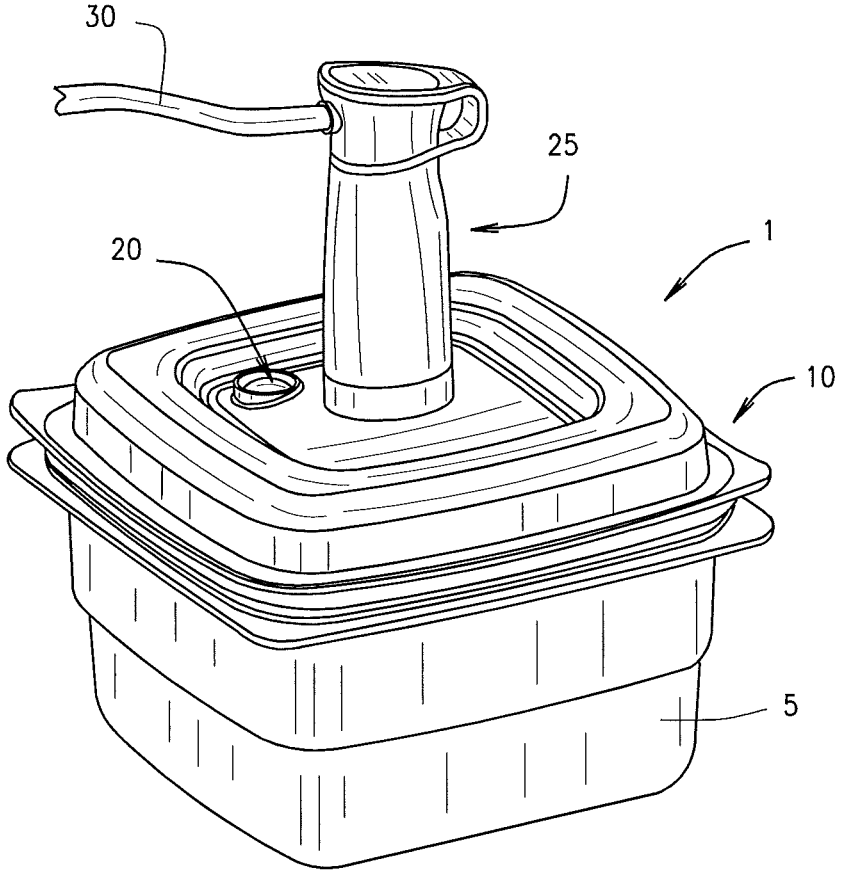
FIG. 2 is a perspective view similar to FIG. 1 showing a typical vacuum adapter engaged with the present valve assembly.

In FIG. 2, a vacuum adapter 25 is shown as having been mated with the lid member 10 so as to form a seal with the valve assembly 15. The manner in which the vacuum adapter 25 and the lid member 10 may be selectively mated is described below. When the vacuum adapter 25 is mated with the lid member 10 to form a seal with the valve assembly 15, a user may use a vacuum seal appliance like those known and understood in the art to create a vacuum within the food storage container 5. More particularly, a hose member 30 is preferably in fluid communication at one end (not illustrated) with a vacuum seal appliance able to vacuum pump air out of a container to create a vacuum therein. At its other end, the hose member 30 is in fluid communication with the vacuum adapter 25 as shown in FIG. 2.

Figure 3:
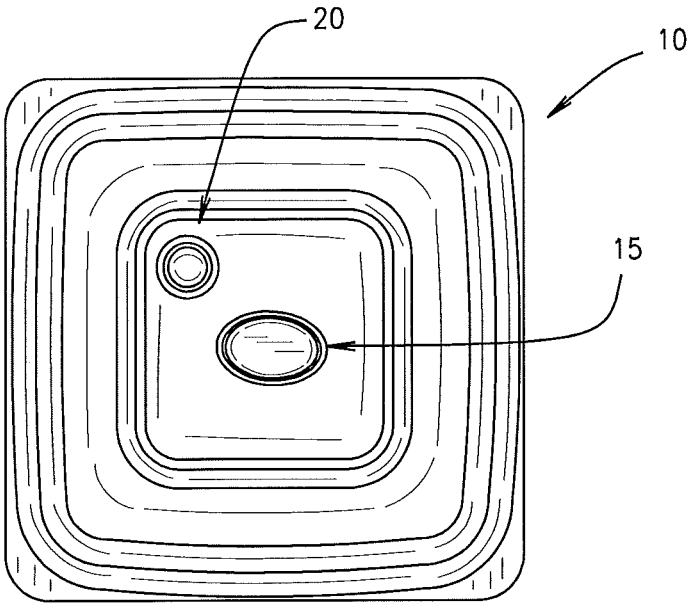
FIG. 3 is a top plan form view of the lid member of FIG. 1 showing the present valve assembly and vacuum indicator positioned and located on the lid member.

When the vacuum seal appliance is activated in a manner known and understood in the art, the vacuum sealing appliance will interact with the vacuum adapter 25 via the hose 30 and the valve assembly 15 to create a vacuum within the food storage container 5. The specific manner in which the valve assembly 15 may interact with the vacuum seal appliance is described below in greater detail. However, it should be noted that when the vacuum seal appliance has been used to create a vacuum within the food storage container 5, it is virtually impossible to remove the lid member 10 from the food storage container 5. Thus, in order to remove the lid member 10 from the container 5 once the vacuum has been created, vacuum pressure within the container 5 must be released using the valve assembly 15. As shown in FIG. 3, the valve assembly 15 is substantially oval in shape so that the bottom portion of the vacuum adapter (not illustrated in FIG. 3), which is also oval in shape, is able to form a seal with the valve assembly 15. When other adapters with other shapes are used, the valve assembly 15 may take on the shape of those other adapters.

Figure 4:
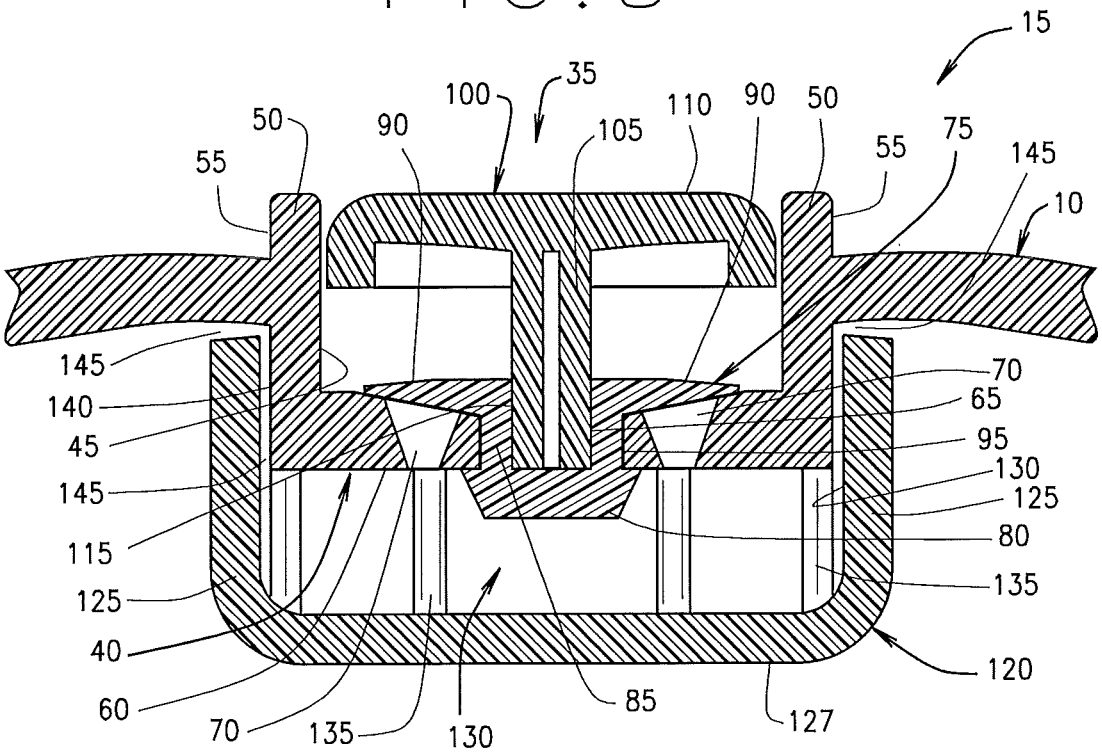
FIG. 4 is a partial cross-sectional view taken through the lid member and the present valve assembly showing the valve assembly in its closed position.

Turning now to FIG. 4, a cross section of the lid member 10 and the valve assembly 15 is provided. In one embodiment, near a central portion 35 of the lid member 10, a central cavity member or recessed area 40 is provided in the lid member 10. The central cavity member 40 is a portion of the lid member 10 that extends downwardly therefrom to form a cavity or recess created in the direction of the food storage container 5. The central cavity member 40 may take on a number of shapes and sizes, but in the illustrated embodiment, is also oval so that the valve assembly 15 may be securely positioned and located within the central cavity member as described below.

The central cavity member 40 includes a wall member 45 that extends around the circumference of the central cavity member 40. In the illustrated embodiment, a rim, flange or lip portion 50 of the wall member 45 preferably extends upwardly from the lid member 10 such that it is in a higher plane than the rest of the lid member 10. When the vacuum adapter 25 is selectively engaged with the lid member 10, it is preferably engaged such that its inner wall (not illustrated) abuts or engages an outer surface 55 of the lip portion 50. The seal between the outer surface 55 of the lip portion 50 and the inner wall of the vacuum adapter 25 is preferably airtight so that the vacuum adapter 25 and its associated vacuum seal appliance may work in the manner described hereinbelow to generate a vacuum pressure in the food storage container 5. In alternative embodiments, the vacuum adapter 25 may be otherwise engaged to the lid member 10, for example, by a recessed portion, rather than the raised lip portion 50.

A central opening 65 is provided at a bottom portion 60 of the central cavity member 40. In addition to the central opening 65, at least one air hole 70 is also provided near the bottom portion 60 of the central cavity member 40 adjacent to the central opening 65. In the embodiment illustrated in FIG. 4, at least two air holes 70 are provided, but in alternative embodiments, more or fewer air holes 70 may be present at the bottom portion 60 of the central cavity member 40. Each of the central opening 65 and the air hole 70 extend entirely through the surface of the central cavity member 40.

A valve member 75 of the valve assembly 15 is preferably secured within the central opening 65. The valve member 75 includes each of a lower stopper portion 80, a central body portion 85, and an upper flanged portion 90. In one embodiment, the stopper portion 80, body portion 85, and flanged portion 90 are integrally formed to create a unitary valve member 75. The valve member 75 should be made of a flexible yet sturdy material. The valve member 75 is preferably made of silicone, but other flexible or semi-flexible materials are also suitable alternative materials.

When the valve member 75 is secured within the central opening 65, the body portion 85 of the valve member 75 preferably abuts a wall member 95 that circumscribes the central opening 65. The stopper portion 80 preferably has a circumference greater than the circumference of the central opening 65 so that the stopper portion 80 fully covers and extends over the central opening 65 and so that the valve member 75 may be more securely retained within the central opening 65. Thus, if a user were to pull upwardly on the valve member 75, because the stopper portion 80 has a circumference greater than the central opening 65, it would be difficult to remove the valve member 75 from the central opening 65.

The flanged portion 90 is also preferably substantially annular in shape. Moreover, the flanged portion 90, like the stopper portion 80, preferably also has a circumference greater than the central opening 65 and greater than the distance to the air holes 70 such that the flange portion 90 extends over and covers the air holes 70 when the valve member is positioned within the central opening 65. When the valve member 75 is secured within the central opening 65, the valve member 75 does not fall through the central opening 65 and into the food storage container 5.

The valve assembly 15 also includes a vacuum release button 100. The illustrated vacuum release button 100 includes each of a stemmed portion 105 and a cap portion 110 which, in the illustrated embodiment, are integrally formed. The capped portion 110 preferably acts as an activating button that operates with the stemmed portion 105 and valve member 75 to release vacuum pressure within the container 5 as will be hereinafter described in greater detail when describing FIG. 6 below. The stemmed portion 105 of the vacuum release button 100 extends downwardly from the capped portion 110 and preferably has a circumference just smaller than a circumference of a valve cavity 115 that extends downwardly into the valve member 75. The valve cavity 115 receives and engages the stemmed portion 105 of the vacuum release button 100 when the valve assembly 15 is assembled.

As shown in FIG. 4, the stemmed portion 105 of the vacuum release button 100 extends into each of the flanged portion 90 and body portion 85 of the valve member 75, but in alternative embodiments, it may extend either shallower or deeper, so long as the vacuum release button 100 may be securely contained within the valve cavity 115.

In FIG. 4, the valve assembly 15 in its normal, closed position. This is the position that the valve assembly 15 is in when air is neither being evacuated nor introduced into the food storage container 5. In this normal, closed position, the central opening 65 is preferably sealed because of the engagement made with the stopper portion 80 and the body portion 85 of the valve member 75. Additionally, an airtight seal is preferably created between the air holes 70 and the annular flanged portion 90 of the valve member 75. In this normal, closed position, air cannot enter or exit the food storage container 5 because of the seal created between the various portions of the valve member 75 and the central opening 65 and the air holes 70.

When a user wishes to evacuate or introduce air from or to the food storage container 5 using the present valve assembly 15, the flanged portion 90 of the valve member 75 is flexed or moved so as to at least partially uncover the air holes 70. The manners in which the flanged portion 90 of the valve member 75 may be moved or flexed away from the air holes 70 to either evacuate air from within the food storage container 5 to create a vacuum therewithin or to introduce air into the food storage container 5 by using the vacuum release button 100 are described in greater detail below when describing FIGS. 5 and 6 respectively.

FIG. 4 also illustrates a dust or particle cover member 120 that is releasably engageable with the central cavity member 40 of the lid member 10. The cover member 120, when attached to the central cavity member 40, helps to prevent dust and other particles from contents within the food storage container 5 from coming into contact with the valve assembly 15 or clogging the air holes 70. If dust, particles, and/or other debris frequently come into contact with the various components of the present valve assembly 15 or clog the air holes 70, over time the valve assembly 15 may become damaged and less effective.

The cover member 120 is not a required component of the food storage system 1. However, when the cover member 120 is provided, it is releasably engaged with the lid member 10 so that a user may remove it if he or she chooses to do so.

Figure 8:
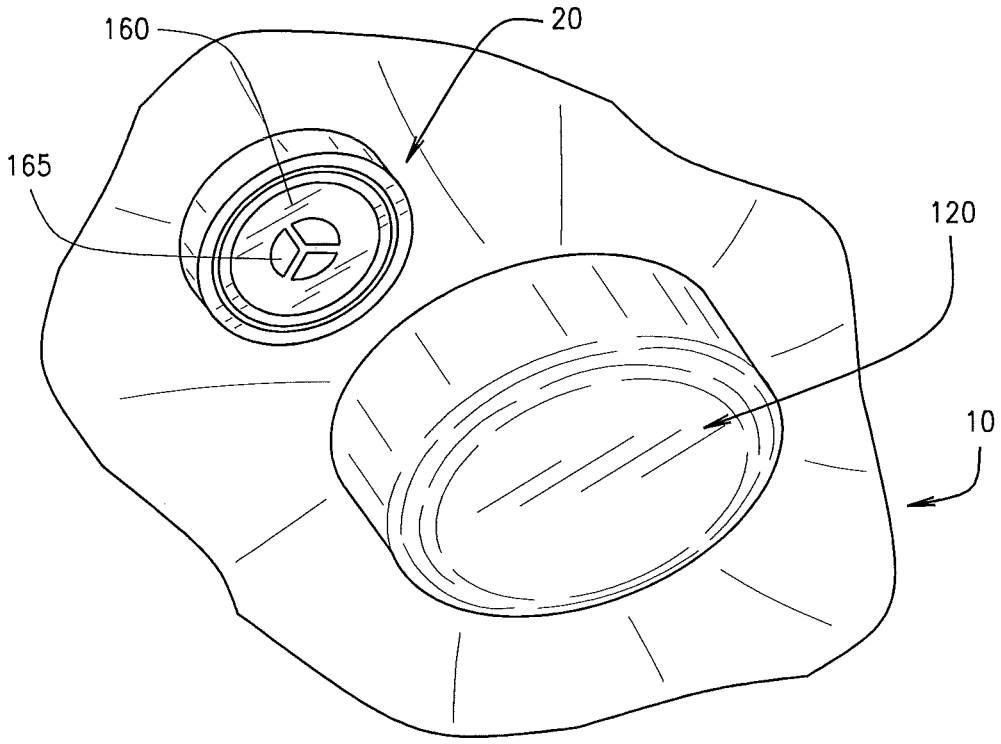
FIG. 8 is a partial perspective view of the inner surface of the lid member showing the dust/particle cover member positioned over the present valve assembly and the first base member associated with the vacuum indicator.

The cover member 120 is illustrated as being oval in shape so that it is releasably engageable with the oval central cavity member 40 as best seen in FIG. 8. The cover member 120 includes a circumferential wall portion 125 that extends upwardly from a flat protective surface 127, towards the inner surface of the lid member 10. An inner surface 130 of the circumferential wall portion 125 preferably includes a plurality of rib members 135 that extend longitudinally along the inner surface 130 and protrude therefrom. The plurality of rib members 135 may be spaced at approximately equal distances from one another around the circumferential wall portion 125.

Similarly, rib receiver members (not illustrated) may be intermittently spaced apart from one another and extend longitudinally along an Outer surface 140 of the wall member 45 where the wall member 45 extends downwardly from the lid member 10, near the bottom portion 60 of the central cavity member 40. The rib receiver members are preferably spaced equally apart from one another so that they align with the rib members 135 when the cover member 120 is attached to the central cavity member 40. The rib receiver members may, like other mating mechanisms known and understood in the art, form a friction fit with the rib members 135 to releasably secure the cover member 120 to the central cavity member 40. This attachment can simply be any snap fit friction attachment.

When the central cavity member 40 has been releasably coupled with the cover member 120, at least one gap 145 is provided between the lid member 10 and the circumferential wall portion 125 of the cover member 120. In a preferred embodiment, however, the gap 145 is present around the entirety of the lid member 10 and the circumferential wall portion 125. Thus, when air is evacuated from or introduced into the food storage container 5 in one of the manners described hereinbelow, there is still fluid communication between the environment and the food storage container 5.

Figure 5:
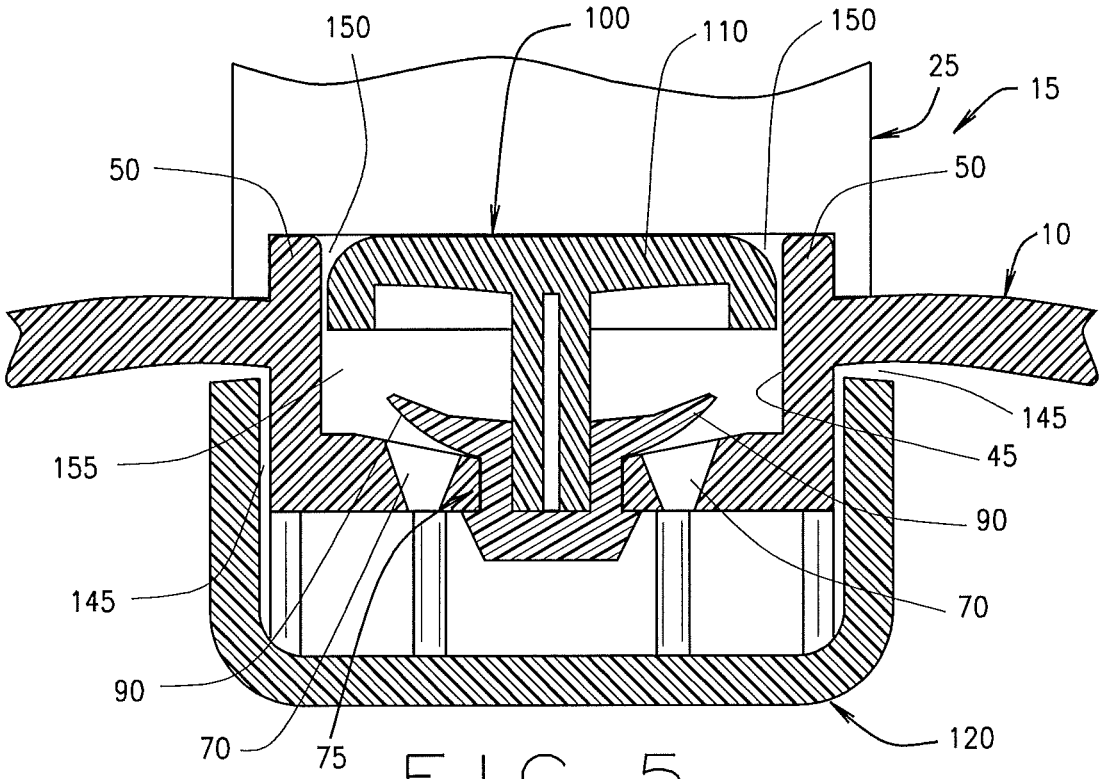
FIG. 5 is a partial cross-sectional view similar to FIG. 4 showing the present valve assembly in its open position when a vacuum is being generated within the storage container.

Turning now to FIG. 5, a second open position of the valve assembly 15 is illustrated. More particularly, in FIG. 5, a vacuum adapter such as the vacuum adapter 25 has been releasably engaged with the lip member 50 of the lid member 10 to create a seal with the valve assembly 15. Upon activating the vacuum sealing appliance associated with the vacuum adapter 25, a vacuum force is created by the vacuum adapter 25. Because a circumferential gap 150 is also present between at least part of the capped portion 110 of the vacuum release button 100 and the wall member 45 and lip member 50, the vacuum force may be applied within the valve assembly 15 as will be further described and a vacuum can be pulled on the container 5. When a vacuum pressure is first introduced by the vacuum seal appliance and vacuum adapter 25, the pressure is first applied to a first chamber 155 between the capped portion 110 and the valve member 75. When pressure has sufficiently accumulated in this first chamber 155, the flexible annular flanged portion 90 is sucked or moved upwardly toward the vacuum adapter 25. This causes the flanged portion 90 to flex and rotate upwardly away from the air holes 70 in the manner shown in FIG. 5 such that the seal between the flanged portion 90 and the air holes 70 is broken. Now, with the air holes 70 exposed to the first chamber, the vacuum force provided by the vacuum seal appliance or other vacuum seal device is able to draw air from within the food storage container 5 directly or indirectly by way of the cover member 120 and gap 145 so as to evacuate the air from within the container 5 to create a vacuum therewithin.

It should be noted that the annular flanged portion 90 of the valve member 75 may be tapered such that it is thinner as the flanged portion 90 becomes more distal to the center of the valve member 75. Because the flanged portion 90 may be thinner as it extends distally, it may require a less pulling or sucking force to cause the flanged portion 90 to be flexed or moved at least partially away from the air holes 70, thus breaking the seal therebetween. It should further be noted that it is not necessary for a vacuum force to be applied to the food storage container 5 to cause the flanged portion 90 to be completely removed from contact with the air holes 70. Rather, the flanged portion 90 need only be partially removed from the air holes 70 to allow air to be drawn through the air holes 70 from the food storage container 5, either directly or indirectly.

When a user wishes to evacuate air from the food storage container 5 to generate a vacuum therein and initiate the above process of at least partially uncovering the flanged portion 90 from contact with the air holes 70, the user will attach the vacuum adapter 25 and its associated vacuum seal appliance to the top portion 50 and activate the vacuum seal appliance. In one method of operation, the user may keep the vacuum seal appliance activated for so long as he or she chooses in order to remove a sufficient amount of air to create a vacuum within the container 5. Alternatively, a user may simply observe the vacuum indicator 20 to determine when sufficient air has been removed from the food storage container 5 before turning off the vacuum sealing apparatus in a known manner as will be hereinafter further explained. As a third option, a user may use a vacuum seal apparatus that includes an automatic pressure sensor and has an automatic shutoff associated therewith when all or substantially all of the air has been removed from within the container 5 by the vacuum sealing apparatus.

When the vacuum seal appliance is turned off, the valve assembly 15 returns to its normal, closed position as shown in FIG. 4. More particularly, the flanged portion 90 of the valve member 75 returns to its position covering the air holes 70 to form an airtight seal therewith and prevent air from entering the food storage container 5. As previously described, with a vacuum pressure generated within the food storage container 5, an airtight seal is formed between the lid member 10 and the container member 5, and it is virtually impossible for a user to remove the lid member 10 from the container 5 without assistance.

Figure 6:
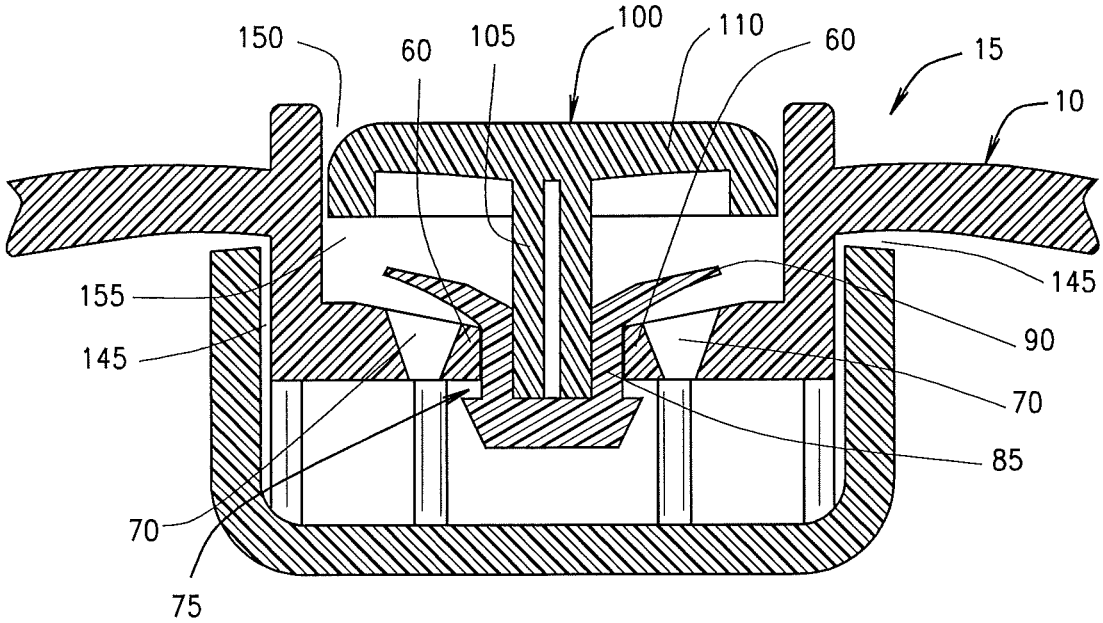
FIG. 6 is a partial cross-sectional view similar to FIG. 5 showing the present valve assembly in its open position when the vacuum release button has been depressed in order to evacuate the vacuum previously generated within the storage container.

A third position of the valve assembly 15 is illustrated in FIG. 6. More particularly, the vacuum release button 100 has been depressed downwardly. A user may wish to depress the vacuum release button 100 when he or she wishes to access the product contained within the food storage container 5 after a vacuum has been introduced to the storage container 5. Because of the very high vacuum pressure created when the vacuum is introduced into the food storage container 5 as illustrated in FIG. 5, a user wishing to access the contents within the food storage container 5 must first evacuate the vacuum pressure and introduce air into the food storage container 5 so that the lid member 10 may be removed from the food storage container 5. To activate the release button 100 to evacuate the vacuum pressure within the container 5, a user simply pushes downwardly on the capped portion 110 of the vacuum release button 100. In doing so, the stemmed portion 105 acts on the valve member 75 to also push it downwardly. When this happens, a force is applied by the bottom portion 60 of the central cavity member 40 at the location where the flanged portion 90 and the body portion 85 of the valve member 75 intersect. This force causes the flanged portion 90 of the valve member 75 to lift at least partially upwardly and away from the air holes 70. When this occurs, the food storage container 5 is now exposed to ambient air via the air holes 70, first chamber 155, and gaps 145 and 150. This allows air to flow into the food storage container 5 equalizing pressure with the environment thereby allowing the vacuum within the food storage container 5 to escape via the air holes 70, first chamber 155, and gaps 145 and 150. After the vacuum pressure from within the food storage container 5 has been released, the lid member 10 may be removable from the food storage container 5. After releasing the vacuum release button 100, after the vacuum pressure has been eliminated from the food storage container 5, the valve assembly 15 returns to its normal, resting closed position as shown in FIG. 4.

Figure 7:
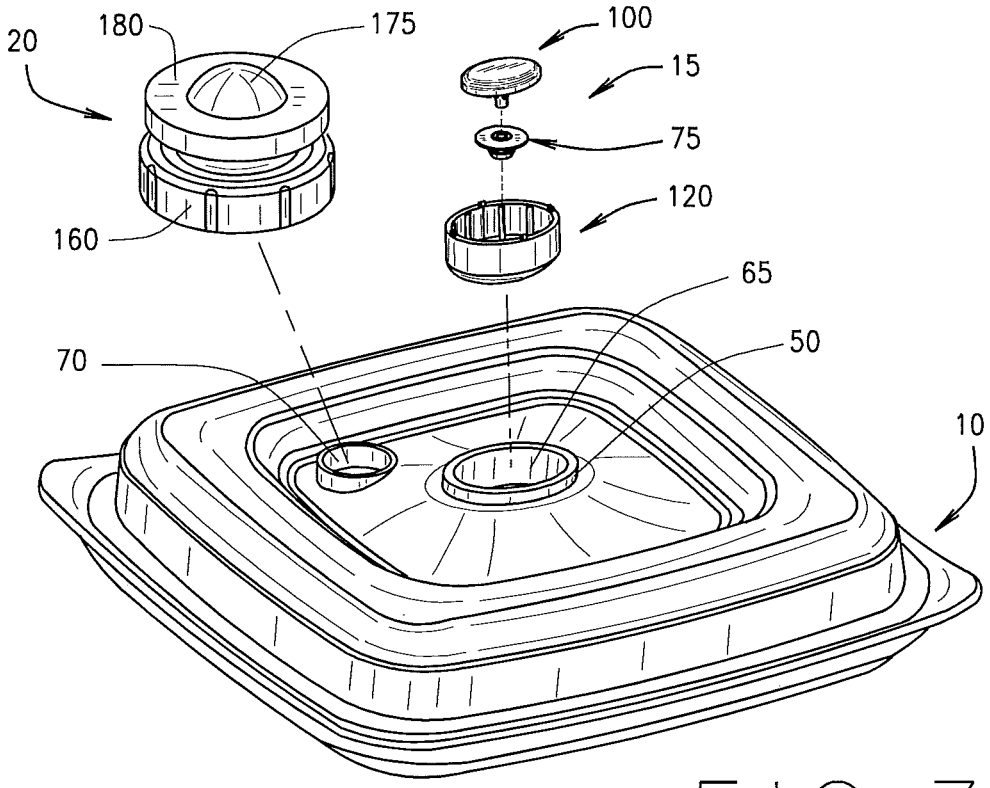
FIG. 7 is an exploded perspective view showing the valve assembly and the vacuum indicator prior to insertion into their respective openings in the lid member, the vacuum indicator being shown in an enlarged format for clarity.

As shown in FIG. 7, the vacuum indicator 20 is located on the lid member 10 for notifying a user when a predetermined vacuum seal has been generated within the storage container 5. In general, the vacuum indicator 20 includes a plastic or other rigid or semi-rigid first base member 160. The base member 160 preferably includes at least one aperture 165 that extends entirely therethrough. The base member 160 is preferably releasably engageable or insertable within an opening 170 in the lid member 10. A second flexible member 175 is also positioned above the base member 160 within the opening 170 in the lid member. In one embodiment, the flexible member 175 is made of a silicone material, but in alternative embodiments, the silicone material may be replaced with any suitable flexible material that will depress when a vacuum is formed within the storage container 5 as will be further explained. In a normal resting position, the flexible member 175 is dimpled shaped and when no vacuum pressure is applied to the flexible member 175, the convex portion of the dimple projects outwardly through the opening 170.

In addition to the first base member 160 and the second flexible member 175, the vacuum indicator 20 also includes a third reinforcement ring member 180 which is positioned above the base member 160 and over flexible member 175 to retain the base member 160 and the flexible member 175 within the opening 170. The reinforcement ring 180 is preferably made of a rigid or semi-rigid material, such as a plastic. The ring member 180 also allows the convex portion of the dimple shaped flexible member 175 to project outwardly through the ring member 180. Collectively, the base member 160, flexible member 175, and reinforcement ring member 180 are selectively engageable with or insertable within the opening 170 in a conventional manner by means known and understood in the art, for example, by a friction fit. When the vacuum indicator 20 is retained in the opening 170 in the lid member 10, an airtight seal is created to prevent air from flowing in or out of the food storage container 5 through the opening 170.

As set forth above, the vacuum indicator 20 may serve to inform a user of the food storage system 1 when a vacuum is or is not present within the food storage container 5. In a scenario where there is not a vacuum present within the food storage container 5, the flexible member 175 is preferably in its naturally occurring convex shape as described above. This convex shaped flexible member 175 is viewable by a user simply by looking at the lid member 10.

Alternatively, when a vacuum is created within the food storage container 5, for example in the embodiment illustrated in FIG. 5, the vacuum pressure generated within the food storage container 5 by the vacuum adapter 25 and an associated vacuum seal appliance also applies a vacuum pressure on the vacuum indicator 20. More particularly, the vacuum created within the food storage container 5 is also applied to the flexible member 175 by traveling through the aperture or apertures 165 within the base member 160. The pulling force of the vacuum, when applied to the flexible member 175, causes the flexible member 175 to bend or depress out of its natural convex position inwardly toward the food storage container 5 to a second concave position. With the flexible member 175 in its concave position, a vacuum has successfully been created within the food storage container 5 and a user can visually see this second position of the flexible member 175 in the vacuum indicator 20 to determine that a vacuum does exist in the storage container 5.

It is also recognized and anticipated that the central opening 65 for receiving the valve member 75 as well as the opening 170 for receiving the vacuum indicator 20 can be positioned and located anywhere on the lid member 10. It is also recognized and anticipated that the openings 65 and 170 can take on a wide variety of different shapes as previously explained so long as the valve assembly 15, the vacuum adapter 25, and the valve indicator 20 are compatible for being engaged with and/or insertable within the respective openings. In addition, it is also recognized that the valve assembly 15 can be engaged and/or inserted with a flat portion of the lid member 10 and that the central cavity member or recessed are 40 is not necessary for incorporation of the valve assembly 15 into the lid member 10. In this regard, other structure can be associated with the lid member to incorporate the valve member 75 as well as the dust cover 120 onto the lid member 10. Still further, it is also recognized that the overall dimensions of the various components of the present valve assembly 15 and vacuum indicator 20 as well as a specific shape and configuration of the various components associated therewith are all subject to wide variations and may be sized and shaped into a variety of different sizes and configurations so as to be compatible with the size and shape of the particular food storage container 5 and/or the lid member 10 associated therewith into which the present structures may be mounted, or to conform with any space limitations associated therewith without impairing the teachings and practice of the present invention. Other variations and modifications to the various components comprising the present structures are also envisioned and contemplated.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A valve assembly for use with a food storage container having a lid member and at least one storage compartment, the valve assembly comprising:

an opening located in the lid member and at least one air hole located adjacent to said opening, the lid member being configured to receive a vacuum adapter associated with a vacuum seal appliance;

a valve member extending through the opening located in the lid member, the valve member having a portion thereof extending over and covering both the opening in the lid member and the at least one air hole when the valve member is in a closed position, the valve member being movable to an open position wherein the portion of the valve member extending over the at least one air hole is at least partially uncovered from the at least one air hole when a vacuum is generated within the at least one storage compartment; and a vacuum release button engageable with the valve member and movable from a first position wherein the valve member is in its closed position to a second position wherein the valve member is moved to its open position wherein the portion of the valve member extending over the at least one air hole is at least partially uncovered from the at least one air hole so as to release the vacuum contained within the at least one storage compartment.

2. The valve assembly defined in claim 1 wherein the opening in the lid member and the at least one air hole positioned adjacent to said opening lie in a recessed area of the lid member.

3. The valve assembly defined in claim 1 wherein the lid member includes a flange portion surrounding the valve assembly for engaging the vacuum adapter associated with a vacuum seal appliance.

4. The valve assembly defined in claim 1 including a dust cover positioned over at least a portion of the valve member and over at least a portion of the at least one air hole, the dust cover being engageable with the lid member.

5. The valve assembly defined in claim 1 wherein the vacuum release button is slidably movable from its first position to its second position.

6. The valve assembly defined in claim 1 wherein said at least one air hole includes a plurality of air holes positioned adjacent the opening in said lid member.

7. The valve assembly defined in claim 1 wherein said valve member is made from a silicone material.

8. The valve assembly defined in claim 1 including a valve indicator located on said lid member for notifying a user when a predetermined vacuum seal has been generated within the at least one storage compartment.

9. The valve assembly defined in claim 8 wherein the vacuum indicator is positioned within a second opening extending through said lid member, said vacuum indicator including a first member positioned within said second opening having at least one aperture associated therewith, a second flexible material positioned adjacent said first member, and a third member positioned adjacent said second member so as to sandwich said second flexible member between said first and third members, said second member forming a raised dimple when the at least one storage compartment is in a non-vacuum state, and said second member being depressed when said at least one storage compartment is in a vacuum state.

10. A valve assembly for use with a food storage container having a lid member and at least one storage compartment, the valve assembly comprising:

a first opening formed in the lid member and a plurality of air holes formed in the lid member adjacent to said first opening, said lid member including a lip portion surrounding said first opening, said lip portion being configured to receive and engage a vacuum adapter associated with a vacuum seal appliance for generating a vacuum within the at least one storage compartment;

a valve member extending through said first opening in said lid member, said valve member having a first portion extending over and covering said first opening and having a second portion extending over and covering the plurality of air holes formed in said lid member when the valve member is in a closed position, said valve member being movable to an open position wherein the second portion of said valve member extending over said plurality of air holes is at least partially uncovered from said plurality of air holes when a vacuum is generated within the at least one storage compartment;

a vacuum release button engageable with the valve member and movable from a first position wherein the valve member is in its closed position to a second position wherein the valve member is in its open position, said vacuum release button allowing the vacuum in the at least one storage compartment to be released when the vacuum release button is moved to its second position; and a vacuum indicator located on said lid member for notifying a user when a predetermined vacuum seal has been generated within the at least one storage compartment.

11. The valve assembly defined in claim 10 including a recess formed in said lid member, said first opening and said plurality of air holes formed in said lid member being located within said recess.

12. The valve assembly defined in claim 11 including a dust cover positioned and located over said valve member, said dust cover being engageable with the recessed portion of said lid member.

13. The valve assembly defined in claim 10 including a second opening formed in said lid member, said vacuum indicator being located within said second opening.

14. The valve assembly defined in claim 13 wherein said vacuum indicator includes a flexible member which depresses from a convex position to a concave position when an airtight vacuum seal has been generated between the lid member and the at least one storage compartment.

15. A food storage container comprising:

a storage container having at least one storage compartment for storing product therewithin;

a lid member engageable with said storage container, said lid member having an opening formed therewithin for receiving a valve member and having at least one air hole formed adjacent to said opening, said lid member being configured to receive a vacuum adapter associated with a vacuum seal appliance around the opening in said lid member for generating a vacuum within the at least one storage compartment;

a valve member positioned within the opening in said lid member, said valve member having a portion thereof extending over and covering the opening in said lid member and having a portion thereof extending over and covering the at least one air hole formed in said lid member when the valve member is in a closed position, said valve member being movable to an open position wherein the portion of said valve member extending over said at least one air hole is at least partially uncovered from said at least one air hole when a vacuum is generated within the at least one storage compartment through the vacuum adapter engaged with the lid member; and a vacuum release button engageable with said valve member, said vacuum release button being movable from a first position wherein said valve member is in its closed position to a second position wherein the valve member is in its open position, said vacuum release button being moved to its second position to release the vacuum generated within the at least one storage compartment.

16. The food storage container defined in claim 15 including a vacuum indicator positioned and located on said lid member for notifying a user when a predetermined vacuum has been generated within the at least one storage compartment.

17. The food storage container defined in claim 15 wherein the lid member includes a recessed area, said at least one air hole and said opening for receiving said valve member being positioned and located in said recessed area.

18. The food storage container defined in claim 15 wherein said lid member includes a lip portion extending around the opening in said lid member for receiving said valve member, said lip portion being engageable with the vacuum adapter associated with a vacuum seal appliance for generating a vacuum within the storage container.

19. The food storage container defined in claim 15 including a dust cover positioned over said valve member, said dust cover being engageable with said lid member.

20. The food storage container defined in claim 16 wherein said vacuum indicator member includes a flexible member which depresses from a convex position to a concave position when a predetermined airtight vacuum seal has been generated between the lid member and the storage container.

* * * * *